US006551152B2

(12) United States Patent
Matsuda et al.

(10) Patent No.: US 6,551,152 B2
(45) Date of Patent: Apr. 22, 2003

(54) JET-PROPULSIVE WATERCRAFT

(75) Inventors: Yoshimoto Matsuda, Hyogo (JP); Keiji Takahashi, Hyogo (JP); Kenichi Nakagawa, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/878,667

(22) Filed: Jun. 8, 2001

(65) Prior Publication Data

US 2001/0051474 A1 Dec. 13, 2001

(30) Foreign Application Priority Data

Jun. 9, 2000 (JP) ..... 2000-173232
Aug. 2, 2000 (JP) ..... 2000-234017
Sep. 14, 2000 (JP) ..... 2000-280432

(51) Int. Cl.[7] ..... B63H 21/22
(52) U.S. Cl. ..... 440/1; 440/87
(58) Field of Search ..... 440/1, 2, 84–87, 440/38; 114/144 R, 144 RG

(56) References Cited

U.S. PATENT DOCUMENTS 6,336,833 B1 * 1/2002 Rheault et al. ..... 440/1

FOREIGN PATENT DOCUMENTS

JP P2001-191992 A 7/2001

* cited by examiner

*Primary Examiner*—Ed Swinehart
(74) *Attorney, Agent, or Firm*—Marshall, Gerstein & Borun

(57) ABSTRACT

The present invention provides a lightweight and simply-configured watercraft of a jet-propulsive type that can maintain steering capability in a way adapted to forward movement and rearward movement of the watercraft even when throttle-close operation is performed and the amount of water ejected from a water jet pump is thereby reduced. During forward movement, when the throttle-close operation and steering operation of a steering handle are detected and an engine speed is between an idling speed and a predetermined engine speed, the engine speed is temporarily increased. During rearward movement, when the engine speed is the idling speed, the engine speed is temporarily increased in the same way. The engine speed is increased by changing a fuel injection timing of a fuel injection system, a fuel injection amount, and/or an ignition timing of an ignition system of the engine.

34 Claims, 15 Drawing Sheets

JET-PROPULSIVE WATERCRAFT

BACKGROUND OF THE INVENTION

1. Field of the Invention

The present invention relates to a jet-propulsive watercraft which ejects water rearward and planes on a water surface as the resulting reaction. More particularly, the present invention relates to a jet-propulsive watercraft that can maintain steering capability even when the throttle is operated to be closed and propulsive force is thereby reduced.

2. Description of the Related Art

In recent years, so-called jet-propulsive personal watercrafts (PWC) have been widely used in leisure, sport, rescue activities, and the like. The personal watercraft is configured to have a water jet pump that pressurizes and accelerates water sucked from a water intake generally provided on a bottom of a hull and ejects it rearward from an outlet port. Thereby, the personal watercraft is propelled.

In the personal watercraft, in association with a steering handle of a general bar type, a steering nozzle provided behind the outlet port of the water jet pump is swung rightward or leftward, to change the ejecting direction of the water to the right or to the left. Thereby, the watercraft is turned to the right or to the left.

A deflector is retractably provided behind the steering nozzle for blocking the water ejected from the steering nozzle from above. The deflector is moved downward to deflect the ejected water forward, and as the resulting reaction, the personal watercraft moves rearward. In some watercraft, in order to move rearward, a water flow is formed from an opening provided laterally of the deflector along a transom board to reduce the water pressure in an area behind the watercraft.

Accordingly, in the above-described personal watercraft, when the throttle is moved to a substantially fully closed position and the water ejected from the water jet pump is thereby reduced, during forward movement and rearward movement, the propulsive force necessary for turning the watercraft is correspondingly reduced, and the steering capability of the watercraft is therefore reduced until the throttle is re-opened.

To solve the above-described problem with a mechanical structure, the applicant disclosed a jet-propulsive personal watercraft comprising a steering component for an auxiliary steering system which operates in association with the steering handle in addition to a steering nozzle for the main steering system in Japanese Patent Application No. Hei. 2000-6708.

SUMMARY OF THE INVENTION

The present invention has been developed for obviating the above-described problem, and an object of the present invention is to provide a jet-propulsive watercraft that can maintain steering capability in a way adapted to forward movement and rearward movement of the watercraft even when the operation for closing a throttle (defined as operation causing at least a part of a descending line Zb of FIG. 11 and hereinafter referred to as "throttle-close operation") is performed and the amount of water ejected from a water jet pump is thereby reduced.

According to the present invention, there is provided a jet-propulsive watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a steering position sensor for detecting a predetermined steering position of the steering operation means; and an electric control unit, wherein the electric control unit is adapted to temporarily increase the speed of the engine when a result detected by the steering position sensor is the predetermined steering position.

According to the jet-propulsive watercraft of the present invention, the engine speed is temporarily increased when the steering operation means is operated and this operation is detected by the steering position sensor. Therefore, the water sufficient to turn the watercraft is ejected from the water jet pump, and the steering capability can be maintained even when the throttle-close operation is performed.

Herein, control for temporarily increasing the engine speed is referred to as "steering assist mode control", and the "throttle-close operation" means that operation is performed to bring the throttle toward a closed position by a predetermined amount or more.

The jet-propulsive watercraft may further comprise a throttle-close operation sensor for detecting throttle-close operation, and the engine speed is temporarily increased when the steering operation is detected by the steering position sensor and the throttle-close operation is detected by the throttle-close operation sensor.

The jet-propulsive watercraft may further comprise an engine speed sensor for detecting an engine speed of the engine, and the engine speed is temporarily increased when the steering operation is detected by the steering position sensor and a result detected by the engine speed sensor is not larger than a first predetermined engine speed.

In this case, when the engine speed becomes the predetermined engine speed or less after the throttle-close operation, transition to the steering assist mode control takes place. Therefore, the steering assist mode control can be effectively started when the water ejected from the water jet pump becomes insufficient to turn the watercraft, regardless of the speed of the watercraft at a point of the throttle-close operation. Also, the engine speed can be temporarily increased when a result detected by the engine speed sensor is not smaller than a second predetermined engine speed.

In the jet-propulsive watercraft, the throttle-close operation may be detected by a throttle position sensor.

It should be noted that the throttle-close operation sensor of the present invention is not limited to the engine speed sensor and the throttle position sensor. For example, it is possible to use a sensor placed in a system connecting a throttle lever and a throttle valve for detecting operation of the system when the throttle-close operation is performed. Also, it is possible to use a sensor for detecting an air-intake pressure and an air-intake amount of the engine. When the air-intake pressure is employed, the relationship between the air-intake pressure and the engine speed is obtained in advance, and according to this relationship, the throttle-close operation is detected only when the engine speed is low.

Under the steering assist mode control, the engine speed can be increased by changing at least any of a fuel injection timing of a fuel injection system of the engine, an ignition timing of an ignition system of the engine, and a fuel injection amount of the fuel injection system of the engine. In this case, the engine speed can be increased without actual operation of the throttle.

It is preferable that the engine speed is increased up to approximately 2500 rpm–3500 rpm as an upper limit under the steering assist mode control.

The jet-propulsive watercraft may further comprise: a speed sensor, and the engine speed can be temporarily increased when the steering operation is detected by the steering position sensor and a result detected by the speed sensor is not larger than a predetermined speed. The speed sensor may comprise an engine speed sensor, a cruising speed sensor, or the like.

It is preferable that the steering assist mode control is not executed particularly when the engine speed is within an idling range while the watercraft is moving forward because this is unnecessary. The idling range is defined as the range from the idling speed to a speed slightly higher than the idling speed and is preferably below approximately 2500 rpm.

The steering assist mode control may be executed even when the watercraft is moving rearward. In this case, it is preferable that the control is executed even when the engine speed is within the idling range.

The above-described steering assist mode control is terminated at any of the following conditions, such as when the steering operation and/or the throttle-close operation is not detected any more, and/or when the detected engine speed or the detected cruising speed is not larger than for example, a relatively low predetermined speed (second predetermined speed) any more, and/or when the detected engine speed or the detected cruising speed is not larger than the second predetermined speed any more or not smaller than for example, a relatively high predetermined speed (first predetermined speed) any more, accordingly the activation of the control should be maintained until any of the above conditions is detected. These conditions can be set for either forward movement or rearward movement of the watercraft. However, the conditions different from the conditions for forward movement can also be set for the rearward movement.

The above and further objects and features of the invention will more fully be apparent from the following detailed description with accompanying drawings.

DETAILED DESCRIPTION OF THE PREFERRED EMBODIMENT

Hereinafter, a jet-propulsive watercraft according to an embodiment of the present invention will be described with reference to accompanying drawings. In this embodiment, a personal watercraft will be described.

First Embodiment

Figure 1:
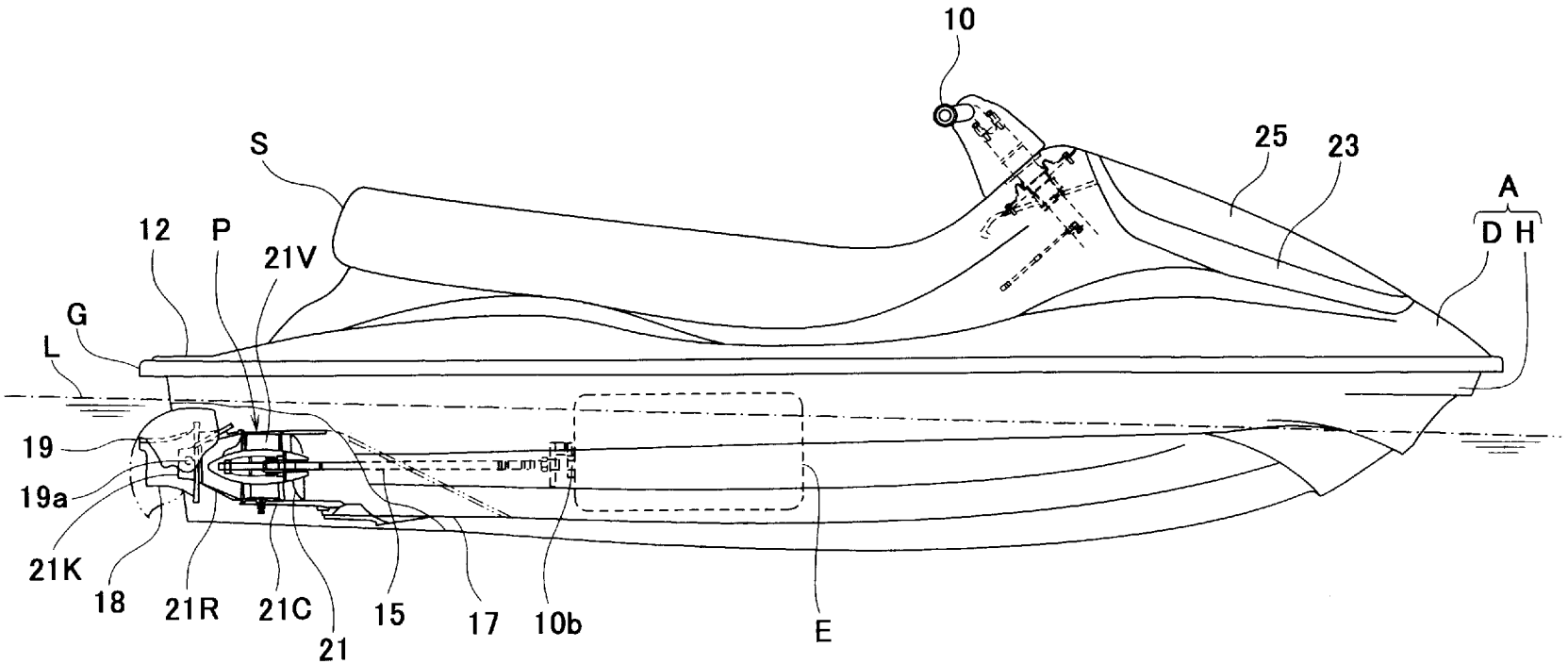
FIG. 1 is a side view showing an entire personal watercraft according to an embodiment of the present invention.
Figure 2:
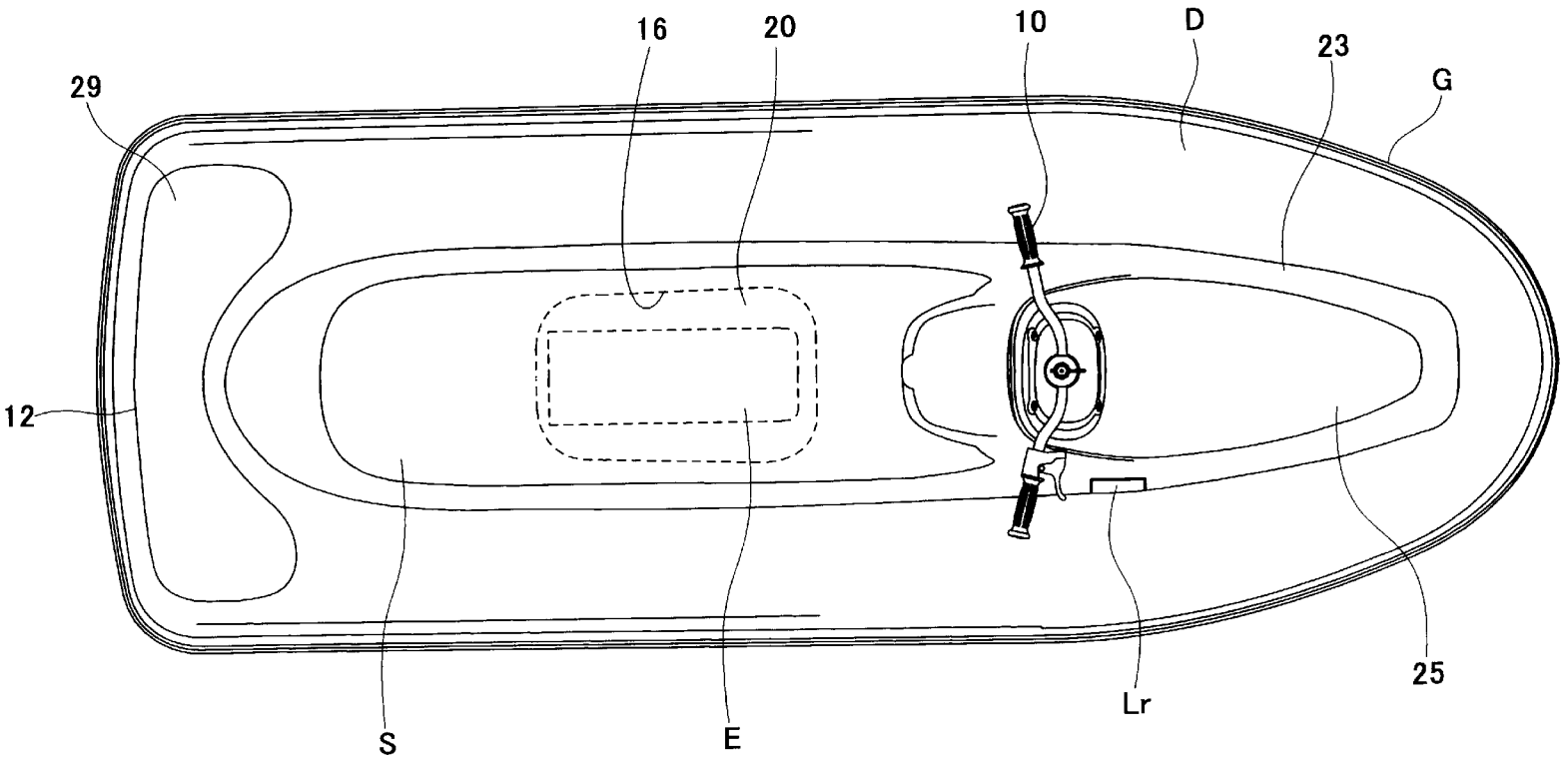
FIG. 2 is a plan view showing the entire personal watercraft of FIG. 1.

FIG. 1 is a side view showing an entire personal watercraft according to an embodiment of the present invention and FIG. 2 is a plan view of FIG. 1. Referring now to FIGS. 1, 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided above the opening 16 such that it covers the opening 16 from above. An engine E is provided in a room 20 surrounded by the hull H and the deck D below the seat S.

The engine E includes multiple cylinders (e.g., three-cylinders). As shown in FIG. 1, a crankshaft 10*b* of the engine E is mounted along the longitudinal direction of the body A. An output end of the crankshaft 10*b* is rotatably coupled integrally with a pump shaft of a water jet pump P through a propeller shaft 15. An impeller 21 is mounted on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining propulsive force. In FIG. 1, reference numeral 21V denotes fairing vanes for fairing water flow behind the impeller 21.

As shown in FIGS. 1, 2, reference numeral 10 denotes a bar-type steering handle as a steering operation means. The handle 10 operates in association with the steering nozzle 18 provided behind the pump nozzle 21R such that the steering nozzle 18 is swingable rightward or leftward. When the rider rotates the handle 10 clockwise or counterclockwise, the steering nozzle 18 is swung toward the respective opposite direction so that the watercraft can be turned to any desired direction when the water jet pump P is generating the propulsive force.

In FIGS. 1, 2, reference numeral 12 denotes a rear deck. The rear deck 12 is provided with an openable rear hatch cover 29. A rear compartment (not shown) with a small capacity is provided under the rear hatch cover 29. Reference numeral 23 denotes a front hatch cover. A front compartment (not shown) is provided under the front hatch cover 23 for storing equipment and the like. A hatch cover 25 is provided over the front hatch cover 23, thereby forming a two-layer cover. A life jacket and the like can be stored under the hatch cover 25 through an opening (not shown) provided in the rear end thereof.

As shown in FIG. 1, a bowl-shaped reverse deflector 19 is provided above the rear side of the steering nozzle 18 such that it can swing downward around a horizontally mounted swinging shaft 19*a*. In this embodiment, as shown in FIG. 2, a reverse switching lever Lr is provided in the vicinity of the handle 10 and at a portion of the body A that is forward of the handle 10 on the right side, for performing switching between forward movement and rearward movement of the watercraft.

Figure 3:
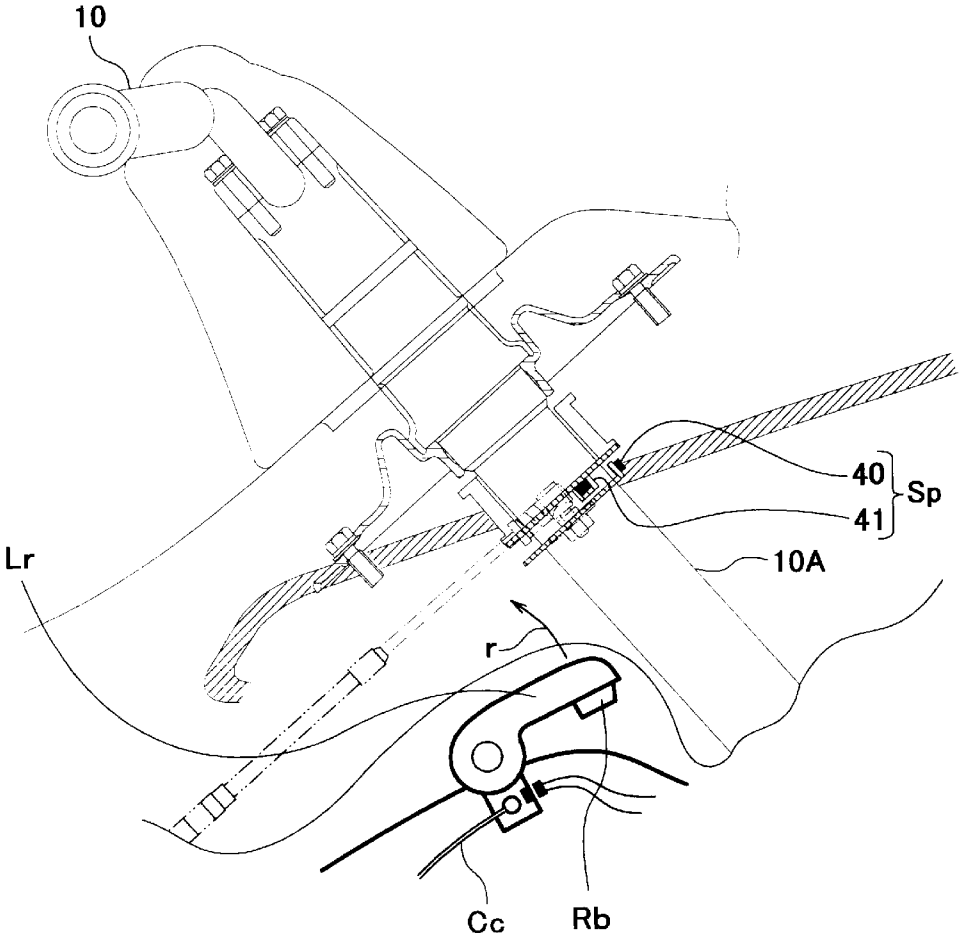
FIG. 3 is a partially enlarged cross-sectional view showing a steering mechanism of FIG. 1.

FIG. 3 is a partially enlarged cross-sectional view showing the steering mechanism of FIG. 1. As shown in FIG. 3, the reverse switching lever Lr is provided with a locking release button Rb at a tip end thereof for locking and releasing swing operation of the lever Lr. The rider presses the locking release button Rb and pivotally raises the reverse switching lever Lr as indicated by an arrow r around a swinging shaft, to pull a cable Cc connected at one end thereof to a base end of the reverse switching lever Lr. Thereby, the deflector 19 connected to the other end of the cable Cc is swung to a lower position rearward of the steering nozzle 18 and the water discharged rearward from the steering nozzle 18 is deflected forward. Thus, switching from forward movement to rearward movement is performed. In this state, upon the rider releasing the locking release button Rb, the raised position of the reverse switching lever Lr is locked and the watercraft is maintained in a rearward movement state. Then, in this state, when the rider re-presses the locking release button Rb and pivotally lowers the reverse switching lever Lr toward the reverse direction, the watercraft can move forward again.

Figure 4:
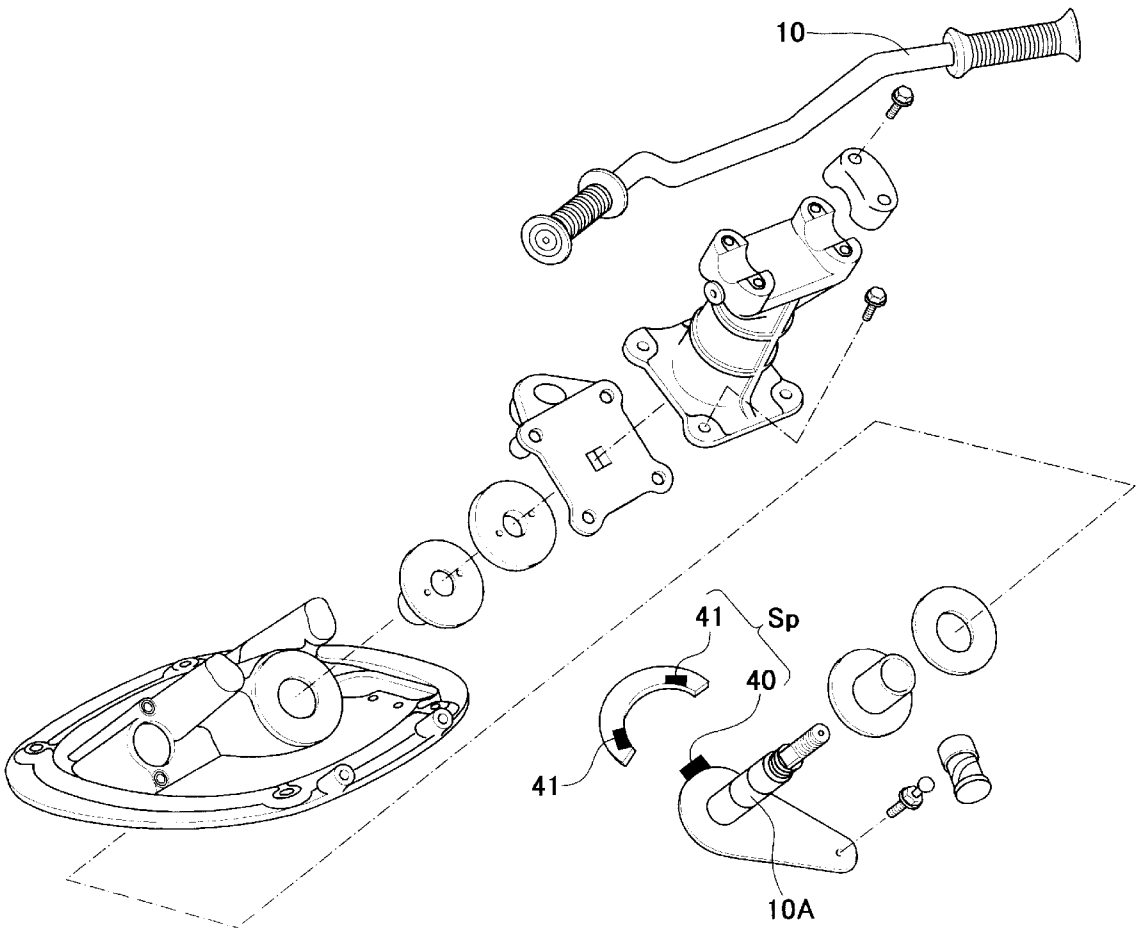
FIG. 4 is a partially exploded perspective view showing the steering mechanism of FIG. 3.

FIG. 4 is a partially exploded perspective view of the steering mechanism. In the personal watercraft of this embodiment, the steering mechanism is provided with a steering position sensor Sp. The steering position sensor Sp is constituted by a permanent magnet 40 and a pair of proximity switches 41. The permanent magnet 40 is attached to a portion of a circular-plate member fixed to a rotational shaft 10A of the steering handle 10. The proximity switches 41 are respectively provided at positions spaced apart from the permanent magnet 40 such that each of these switches forms a predetermined angle (for example, 20 degrees) clockwise or counterclockwise with respect to the permanent magnet 40. When the steering handle 10 is rotated by the predetermined angle, the permanent magnet 40 comes close to the corresponding proximity switch 41, which is turned ON, thereby detecting steering. It should be noted that a potentiometer can be substituted for the position sensor Sp.

Figure 5:
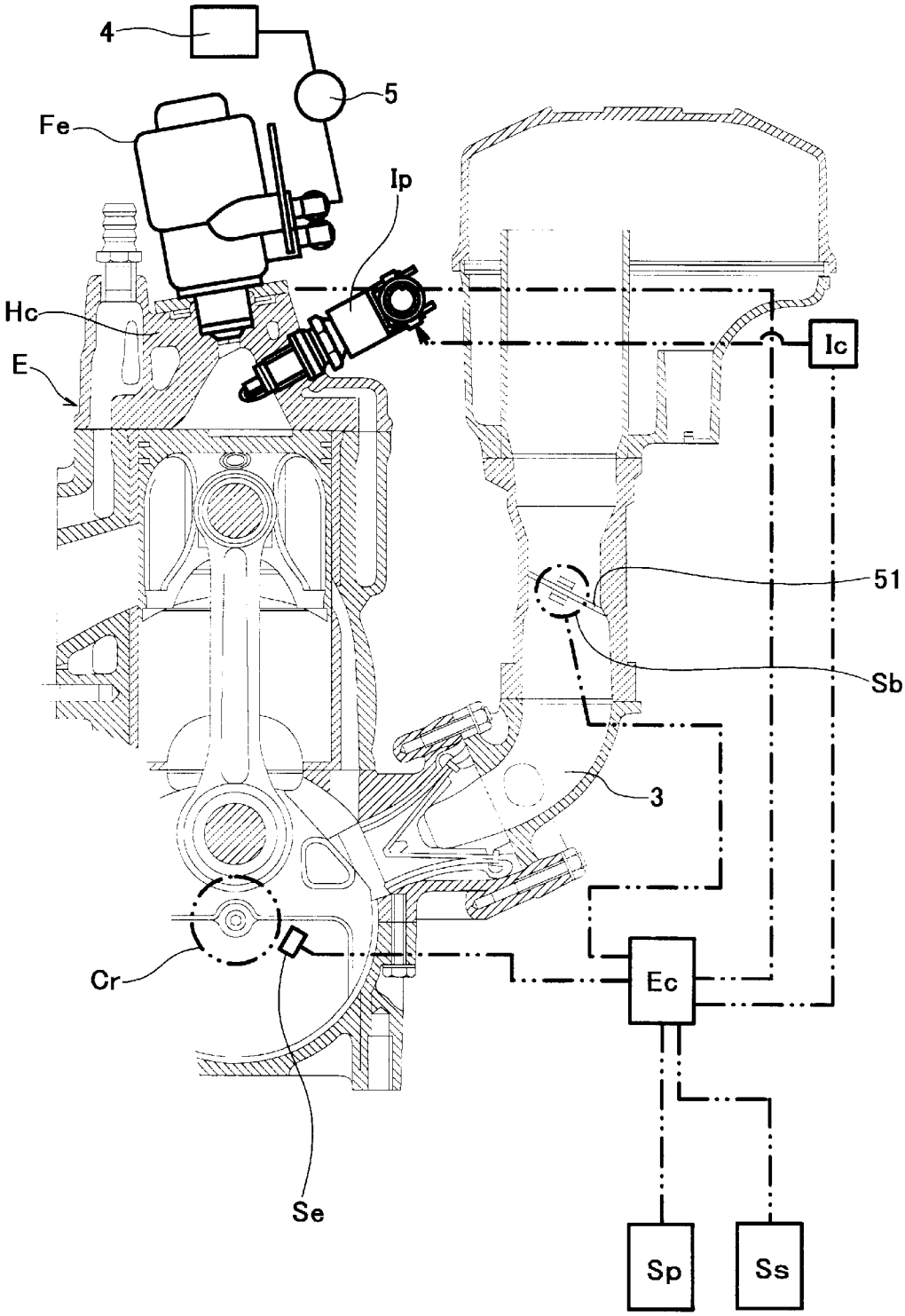
FIG. 5 is a cross-sectional, partly schematic view showing a configuration of a control system of the personal watercraft according to the embodiment of the present invention based on the relationship with the engine.
Figure 6:
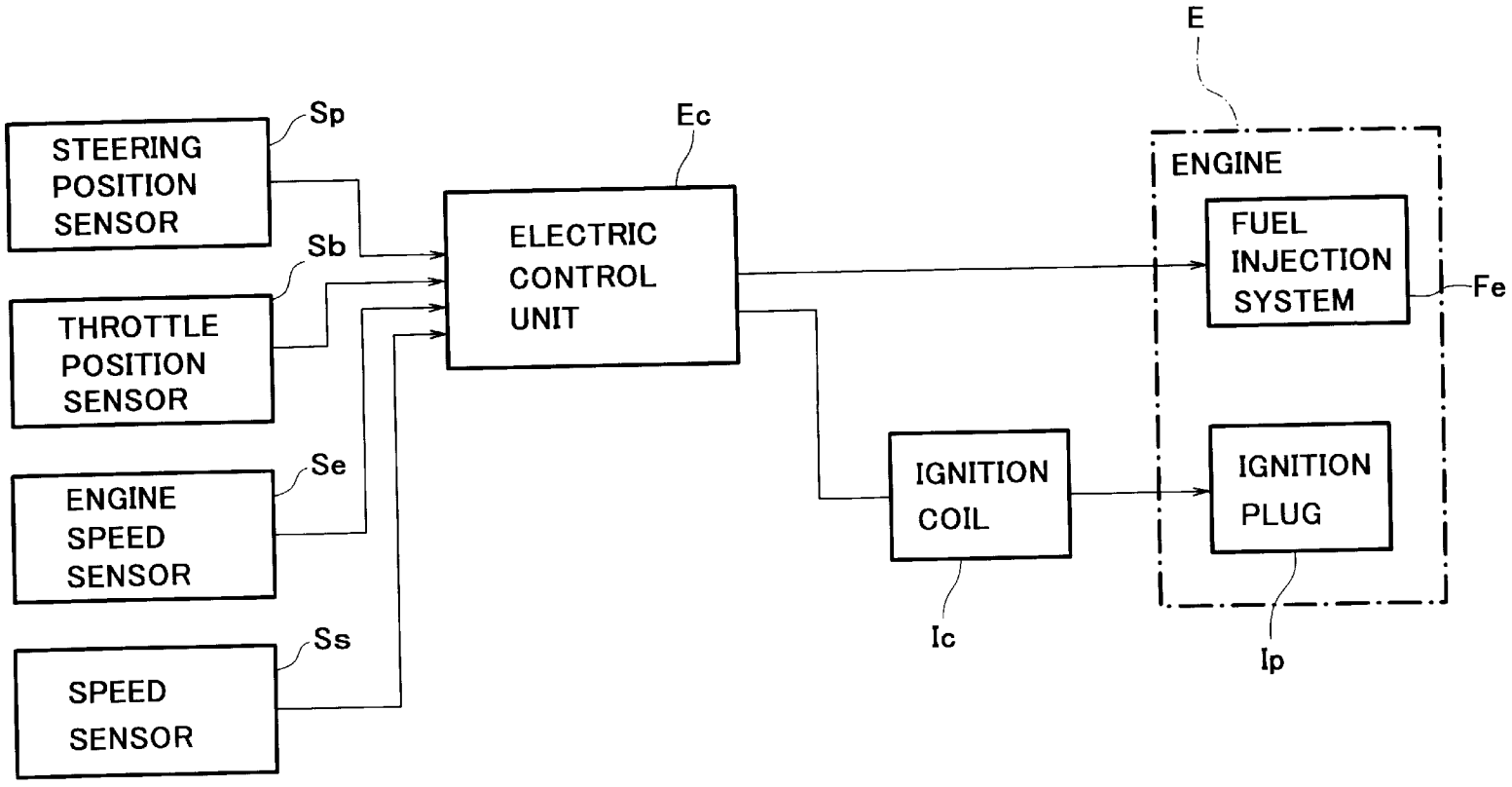
FIG. 6 is a block diagram showing the configuration of the control system of the personal watercraft according to one embodiment of the present invention.

FIG. 5 is a view showing a configuration of a control system of the personal watercraft of this embodiment based on the relationship with the engine. FIG. 6 is a block diagram of the configuration of the control system of FIG. 5. As shown in FIGS. 5, 6, a throttle position sensor Sb is provided close to a butterfly valve 51 placed in an intake passage 3 of the engine E, for detecting that the butterfly valve 51 is closed to some degrees, i.e., throttle-close operation. An engine speed sensor Se is provided in the vicinity of the crankshaft Cr, for detecting the number of revolutions of the crankshaft Cr, i.e., the engine speed of the engine E.

The steering position sensor Sp, the throttle position sensor Sb, and the engine speed sensor Se are respectively connected to an electric control unit Ec through siqnal lines (electric wires). A signal indicating that the steering operation, the throttle-close operation, or the engine speed has been detected by the steering position sensor Sp, the throttle position sensor Sb, or the engine speed sensor Se, is sent to the electric control unit Ec.

The electric control unit Ec is connected to a fuel injection system Fe provided in a cylinder head Hc of the engine E and an ignition coil Ic through signal lines (electric wires). The ignition coil Ic is connected to an ignition plug Ip of the engine E through an electric wire (high-tension cord). In FIG. 5, reference numeral 4 denotes a fuel tank and reference numeral 5 denotes a fuel jet pump.

Thus, the personal watercraft of this embodiment has the above-identified hardware configuration. As described below, when prescribed conditions such as the throttle-close operation occur, transition to the steering assist mode control takes place. The personal watercraft has a function of maintaining steering capability even when the throttle is placed in the closed state. This function is performed by making the electric control unit Ec execute a computer program stored in a memory built in the electric control unit Ec. Subsequently, a control process according to the program will be described with reference to flowcharts of FIGS. 7 through 9.

Figure 7:
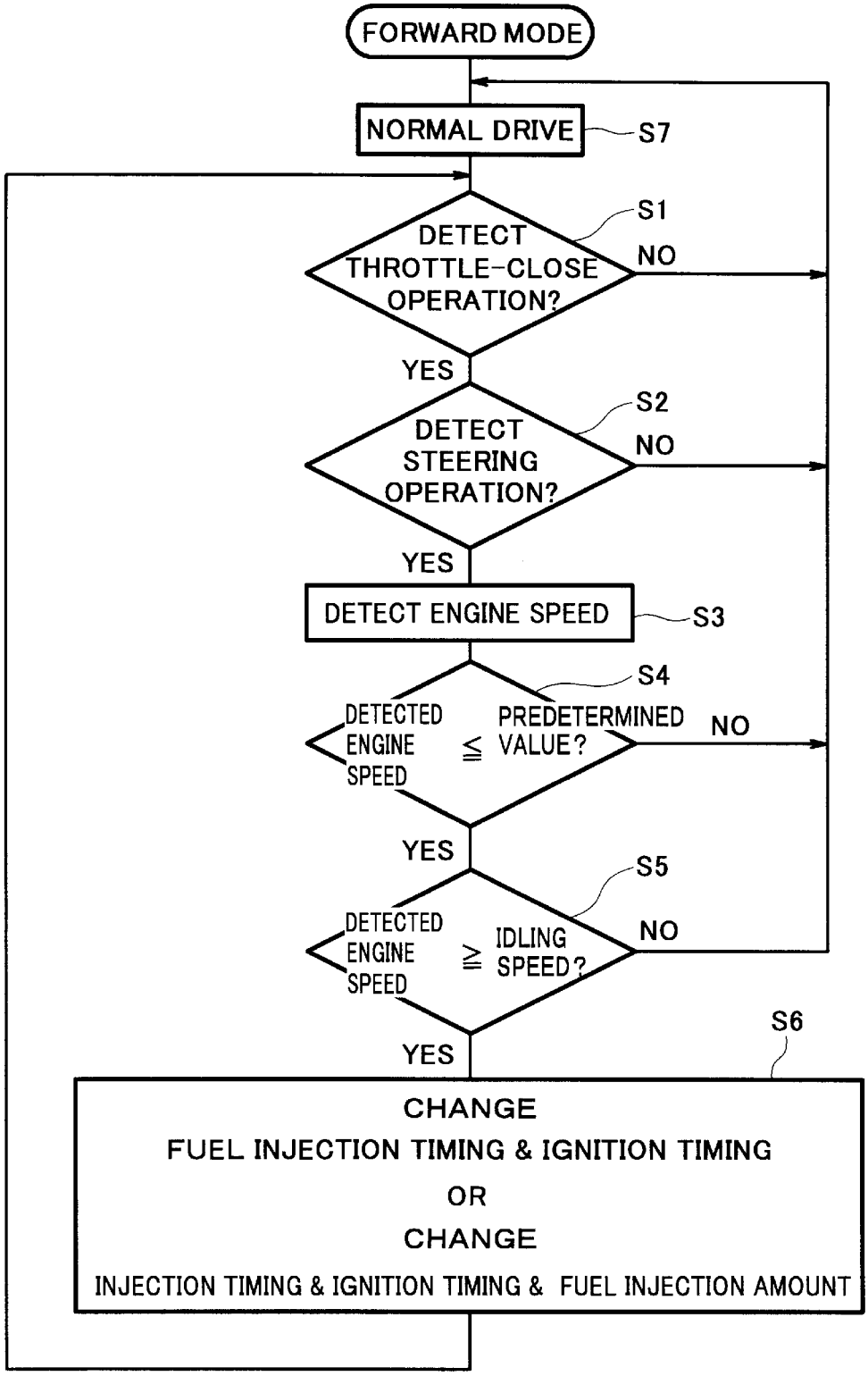
FIG. 7 is a flowchart showing a control process performed under steering assist mode control when the personal watercraft according to the embodiment of the present invention is moving forward.

Referring to FIG. 7, the flowchart shows the control process performed by the electric control unit Ec under the steering assist mode control when the watercraft is moving forward. When the personal watercraft of this embodiment is moving forward, first of all, the electric control unit Ec judges whether or not the throttle position sensor Sb has detected that the rider performed the throttle-close operation (Step S1).

When judging that the throttle-close operation has been detected by the throttle position sensor Sb, ("YES" in Step S1), the electric control unit Ec judges whether or not the steering position sensor Sp has detected that the rider rotated the steering handle 10 by the predetermined angle to the right or to the left (Step S2).

When judging that the steering operation has been detected by the steering position sensor Sp ("YES" in Step S2), the electric control unit Ec reads in the engine speed detected by the engine speed sensor Se (Step S3), and then judges whether or not the detected engine speed is smaller than a predetermined value (for example, smaller than approximately 2500 rpm or smaller than approximately 5500 rpm) (Step S4).

When judging that the detected engine speed is less than the predetermined value ("YES" in Step S4), the electric control unit Ec further judges whether or not the detected engine speed is larger than an idling speed (for example, larger than approximately 800 rpm–2000 rpm) (Step S5). This judgment is made to prevent the steering assist mode control from being executed in certain conditions. This is because the propulsive force is unnecessary when the detected engine speed is smaller than the idling speed, that is, an idling speed within an "idling range".

On the other hand, when judging that the throttle-close operation has not been detected ("NO" in Step S1), the steering operation has not been detected ("NO" in Step S2), the detected engine speed is larger than the predetermined value ("NO" in Step S4), or the detected engine speed is smaller than the idling speed ("NO" in Step S5), the electric control unit Ec maintains an initial drive state, i.e., a normal drive state (Step S7).

When judging that the detected engine speed is not smaller than the idling speed ("YES" in Step S5), the electric control unit Ec starts executing the steering assist mode control to change the fuel injection timing and the ignition timing of the engine E, or these timings and the fuel injection amount (Step S6), thereby temporarily increasing the engine speed.

In this embodiment, in order to increase the engine speed, it is desirable to set faster timings and increase the fuel injection amount, but the present invention is not limited to these. Besides, in view of a turning characteristic of the personal watercraft, a characteristic due to the hull shape of the watercraft, and the like, the engine speed may be increased up to approximately 2500–3500 rpm. For example, the engine speed may be fixed at approximately 3000 rpm or may vary depending on a cruising state of the watercraft.

As the engine speed is employed in judgment of Steps S4, S5, it is desirable to adopt statistical values of sampling results during a given time period rather than a value of one sampling result, taking inertia of the cruising personal watercraft into account.

The electric control unit Ec repeats Steps S1–S6 until it judges "NO" in Step S1, S2, S4, or S5. When judging "NO", the electric control unit Ec sets back the fuel injection timing and the ignition timing of the engine E or these timings and the fuel injection amount, which were changed to increase the engine speed, to the initial drive state, i.e., the normal drive state (Step S7).

In judgment as to whether to start the steering assist mode control, alternatively, Steps 1, 2 may be performed in the reversed order. Also, according to the judgment in Step S2 and the judgment of the engine speed in Steps S4, S5, the steering assist mode control may be started. Likewise, Steps S4, S5 may be performed in the reversed order. Also, Step S4 or Step S5 may be omitted. Further, Step S1 may be omitted and the judgment of the throttle-close operation may be made in Step S4 and/or Step S5.

As should be appreciated from the foregoing description, the personal watercraft of this embodiment can be easily embodied merely by additionally providing the steering position sensor Sp comprising the proximity switches and the like and changing the computer program of the electric control unit Ec, because the conventional personal watercraft is equipped with the throttle position sensor Sb, the engine speed sensor Se, and the electric control unit Ec.

Figure 8:
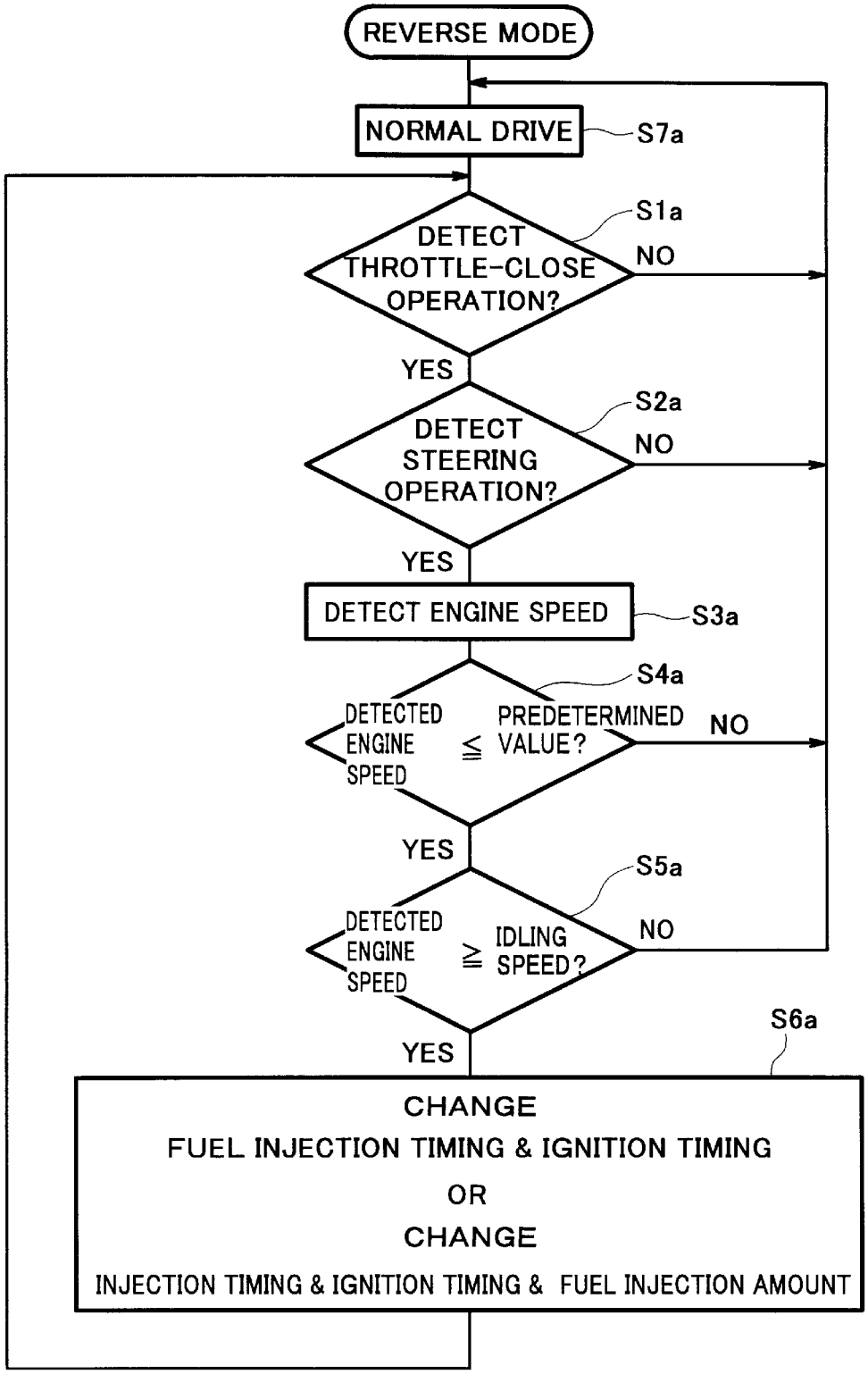
FIG. 8 is a flowchart showing a control process performed under steering assist mode control when the personal watercraft according to the embodiment of the present invention is moving rearward.

When the rider is operating the reverse switching lever Lr to cause the watercraft to move rearward, the electric control unit Ec performs Steps S1*a*–S7*a* of FIG. 8, as in the case of forward movement.

Figure 9:
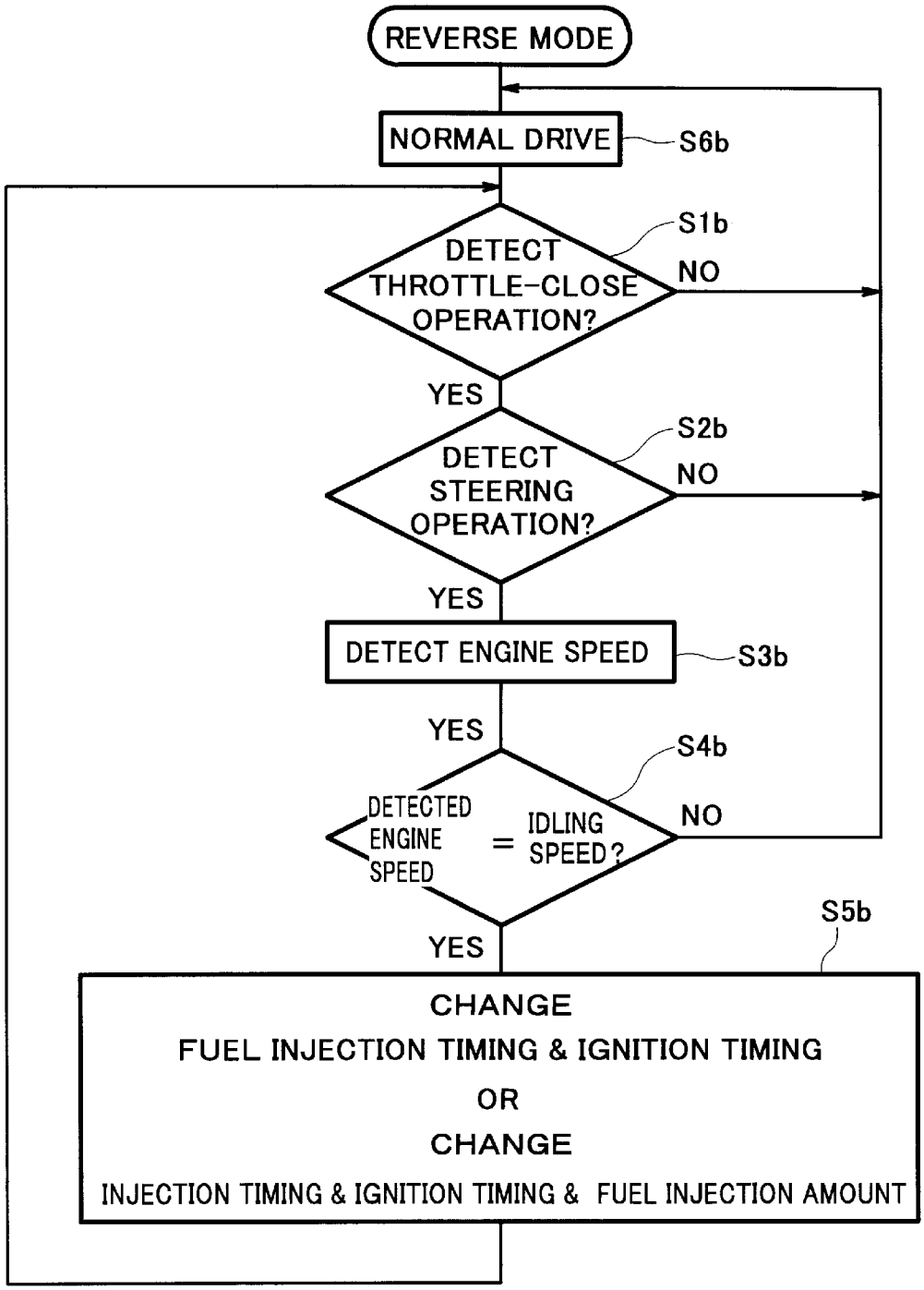
FIG. 9 is a flowchart showing another control process performed under steering assist mode control when the personal watercraft according to the embodiment of the present invention is moving rearward.

The control process of FIG. 8 may be replaced by a control process shown in FIG. 9. Specifically, as shown in FIG. 9, like the control process described above, the electric control unit Ec first executes the detection of the throttle-close operation, the steering operation, and the engine speed (Steps S1*b*–S3*b*), and then judges whether or not the detected engine speed is equal to the idling speed (Step S4*b*). When judging that the detected engine speed is equal to the idling speed ("YES" in Step S4*b*), the electric control unit Ec starts executing the steering assist mode control to change the fuel injection timing and the ignition timing of the engine E, or these timings and the fuel injection amount (Step S5*b*), thereby temporarily increasing the engine speed. When judging that the detected engine speed is not the idling speed ("NO" in Step S4*b*), the electric control unit Ec sets back the fuel injection timing and the ignition timing of the engine E, or these timings and the fuel injection amount, which were changed to increase the engine speed, to the initial drive state, i.e., the normal drive state (Step S6*b*).

Figure 10:
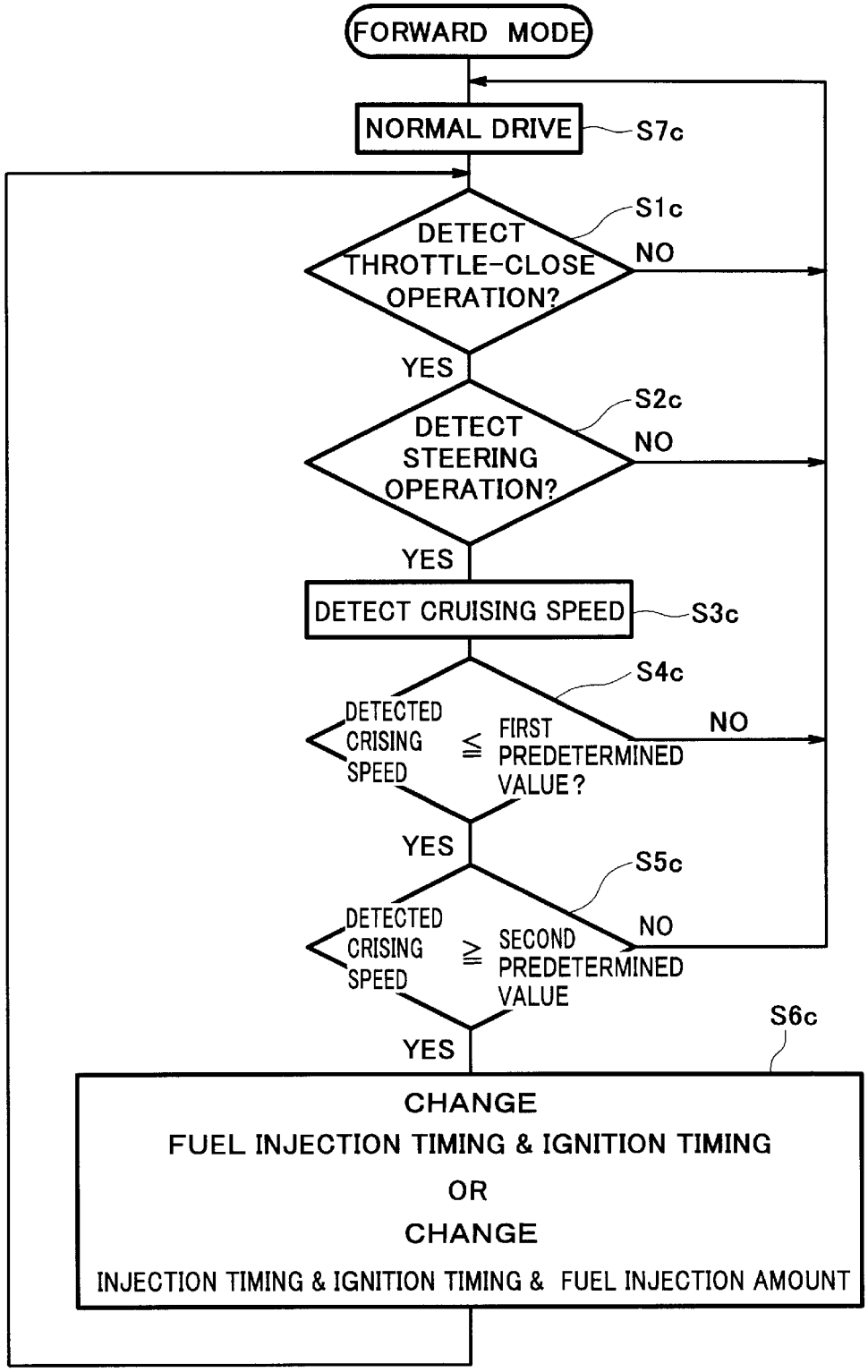
FIG. 10 is a flowchart showing another control process performed under steering assist mode control when the personal watercraft according to the embodiment of the present invention is moving forward.

Furthermore, as shown in FIGS. 5, 6, a speed sensor Ss may be provided for detecting the cruising speed of the watercraft. The speed detected by the speed sensor Ss may be employed instead of the detected engine speed. More specifically, as shown in FIG. 10, first, the electric control unit Ec performs a process similar to Steps S1, S2 of FIG. 7 (Step S1*c*, S2*c*).

When judging that the steering operation has been detected ("YES" in Steps S2*c*), the electric control unit Ec reads in the cruising speed detected by the speed sensor Ss (Step S3*c*), and judges whether or not the detected cruising speed is smaller than a first predetermined value (Step S4*c*).

When judging that the detected cruising speed is smaller than the first predetermined value ("YES" in Step S4*c*), the electric control unit Ec further judges whether or not the detected cruising speed is larger than a second predetermined value (Step S5*c*).

On the other hand, when judging that the throttle-close operation has not been detected ("NO" in Step S1*c*), the steering operation has not been detected ("NO" in Step S2*c*), the detected cruising speed is larger than the first predetermined value ("NO" in Step S4*c*), or the detected cruising speed is smaller than the second predetermined value ("NO" in Step S5*c*), the electric control unit Ec maintains the initial drive state, i.e., the normal drive state (Step S7*c*).

When judging that the detected cruising speed is larger than the second predetermined value ("YES" in Step S5*c*), the electric control unit Ec starts executing the steering assist mode control to change the fuel injection timing and the ignition timing of the engine E, or these timings and the fuel injection amount (Step S6*c*), thereby temporarily increasing the engine speed.

The electric control unit Ec repeats Steps S1*c*–S6*c* until it judges "NO" in Step S1*c*, S2*c*, S4*c*, or S5*c*. When judging "NO", the electric control unit Ec sets back the fuel injection timing and the ignition timing of the engine E, or these timings and the fuel injection amount, which were changed to increase the engine speed, to the initial drive state, i.e., the normal drive state (Step S7*c*).

Timing of the start of the steering assist mode control after the detection of the throttle-close operation and the steering operation may be delayed to give the rider improved steering feeling during the steering assist mode control. The engine speed is rapidly reduced immediately after the throttle-close operation, and correspondingly the propulsive force of the water jet pump P is reduced. Since timing of the start of the steering assist mode control is delayed, the cruising speed is decreased to some degree by the start time of this control, and thereby, the change between the cruising speed at the start point of the steering assist mode control and the cruising speed at the end point of this control can be lessened.

Figure 11:
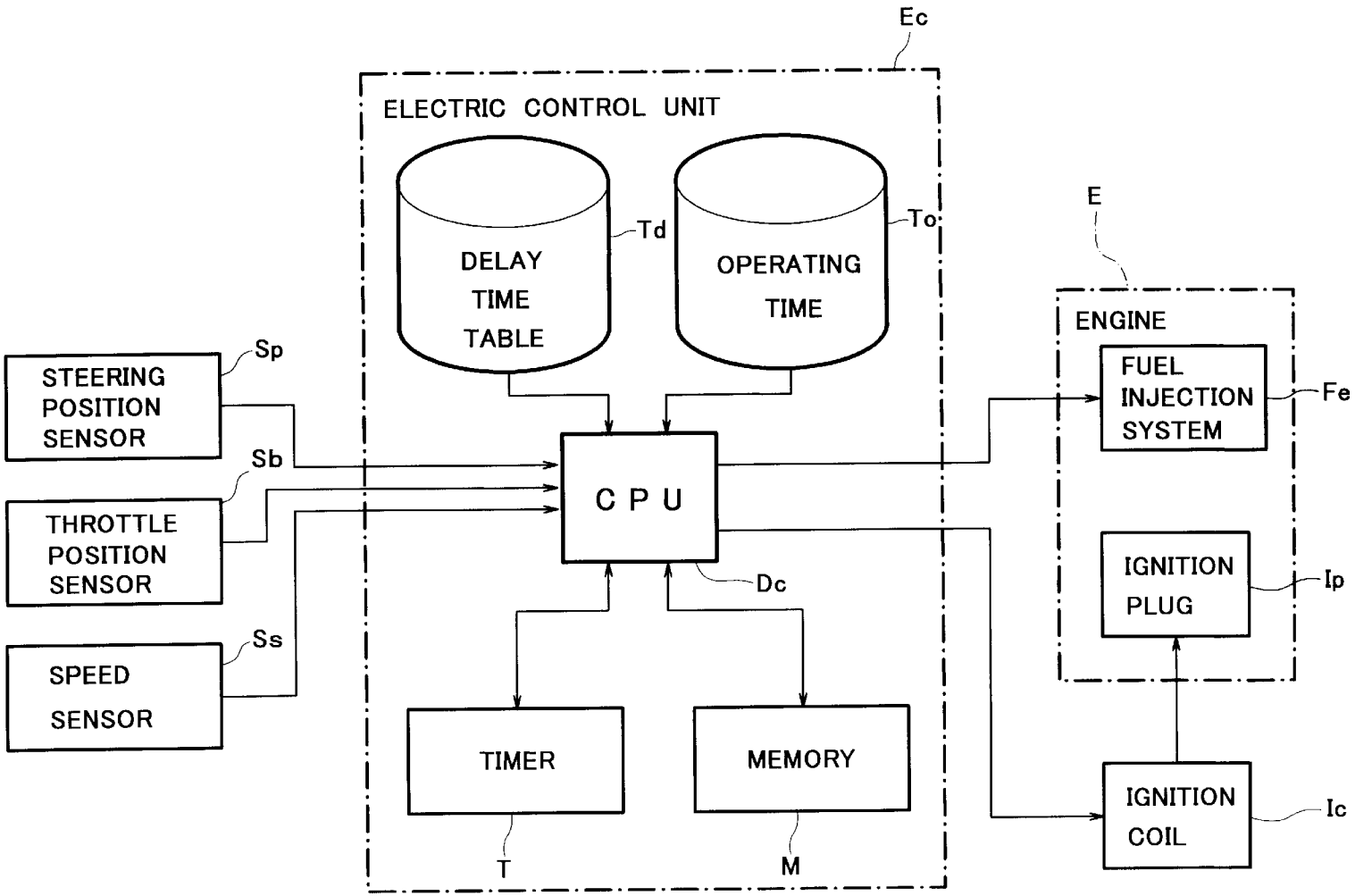
FIG. 11 is a block diagram showing a configuration of a control system of a personal watercraft according to another embodiment of the present invention.
Figure 12:
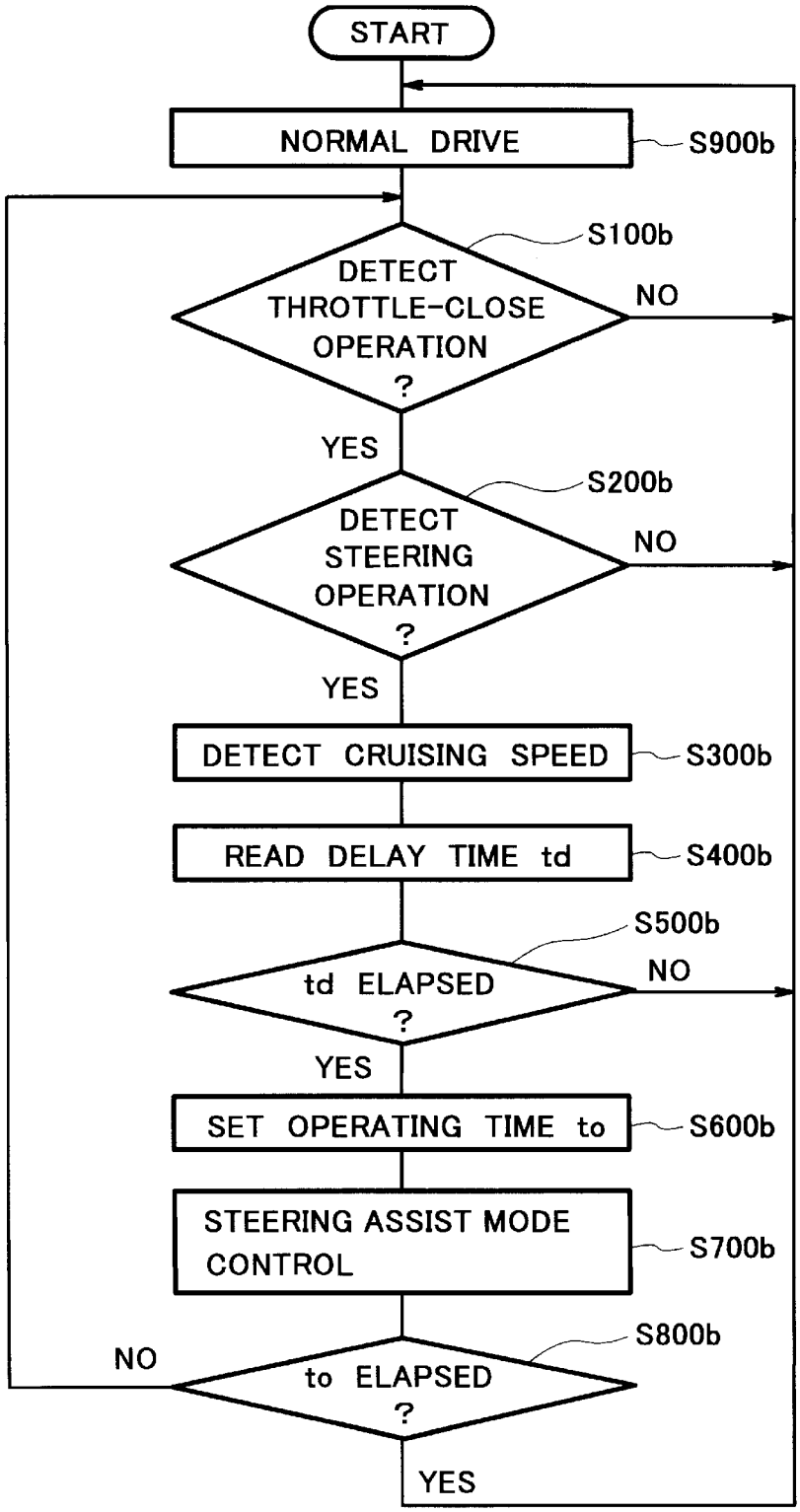
FIG. 12 is a flowchart showing a control process under the steering assist mode control according to the embodiment of FIG. 11.

Referring to FIG. 11, the personal watercraft of this embodiment includes a hardware configuration as follows. The watercraft comprises a steering position sensor Sp, a throttle position sensor Sb, and a watercraft speed sensor Ss as a detecting system. An electric control unit Ec of the watercraft comprises a CPU Dc, a memory M, a delay time table Td, an operating time table To, and a timer T. The electric control unit Ec is adapted to delay the start of the steering assist mode control according to the cruising speed following a flowchart of FIG. 12. In addition to the delay of the start in this embodiment, the time period during which the engine speed is increased under the control is set longer according to the cruising speed.

When the personal watercraft is cruising, first of all, the CPU Dc judges whether or not the throttle position sensor Sb has detected that the rider performed the throttle-close operation (Step S100*b*).

When judging that the throttle-close operation has been detected by the throttle position sensor Sb ("YES" in Step S100*b*), the CPU Dc judges whether or not the steering position sensor Sp has detected that the rider rotated the steering handle 10 by the predetermined angle to the right or to the left (Step S200*b*).

When the judging that the steering operation has been detected by the steering position sensor Sp ("YES" in Step S200*b*), the CPU Dc reads in the cruising speed detected by the speed sensor Ss (Step S300*b*). The cruising speed may be indirectly obtained by the calculation from the engine speed.

Figure 13:
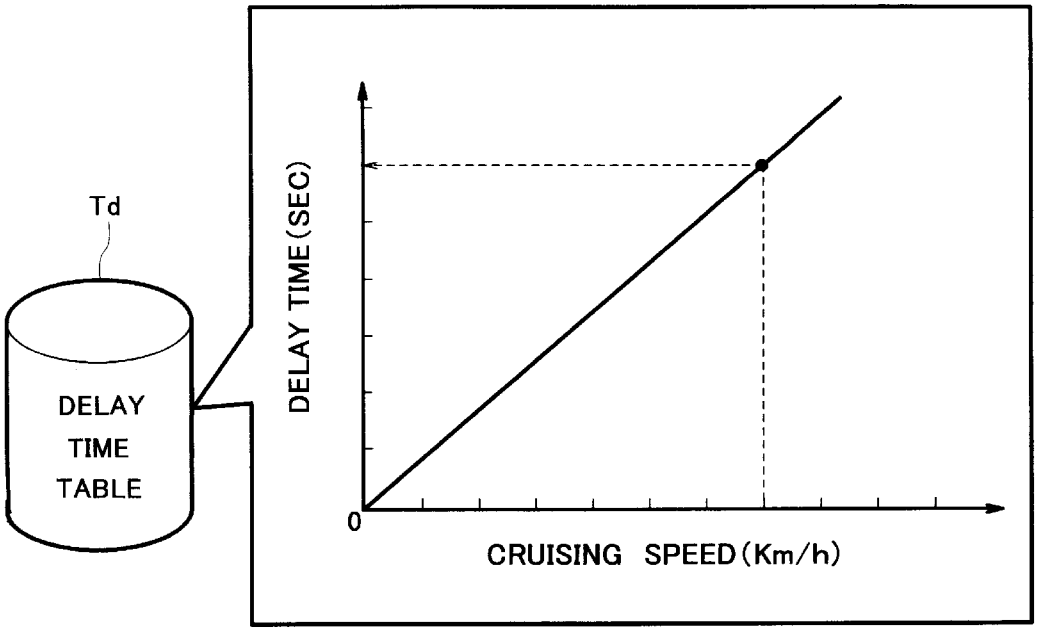
FIG. 13 is a graphic view showing contents of a delay time table of FIG. 11.

The CPU Dc refers to the delay time table Td of FIG. 13 based on the read cruising speed to obtain the corresponding delay time $t_d$ (Step S400*b*). In this embodiment, as shown in FIG. 13, the delay time $t_d$ is set to be in direct proportion to the cruising speed, but this relationship is only illustrative. The CPU Dc controls the timer T to start counting of the obtained delay time $t_d$ and judges whether or not the delay time $t_d$ has elapsed (Step S500*b*)

When the throttle-close operation has not been detected ("NO" in Step S100*b*), the steering operation has not been detected ("NO" in Step S200*b*), or the delay time $t_d$ has not elapsed ("NO" in Step S500*b*), the CPU Dc maintains a current drive state, i.e., a normal drive state (Step S900*b*).

Figure 14:
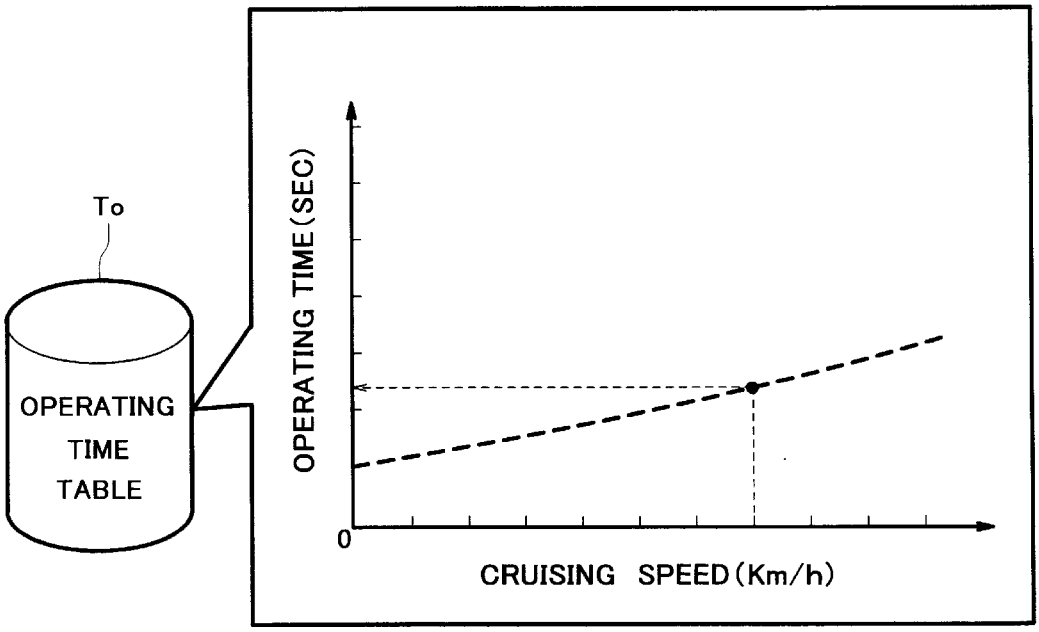
FIG. 14 is a graphic view showing contents of an operating time table of FIG. 11.

On the other hand, when judging that the delay time $t_d$ has elapsed ("YES" in Step 500*b*), the CPU Dc refers to the operating time table To of FIG. 14 based on the cruising speed to obtain the corresponding operating time $t_o$ and sets this operating time for starting the steering assist mode control (Step S600*b*). At this time, the CPU DC controls the timer T to start counting of the set operating time $t_o$. In this embodiment, the operating time $t_o$ is set to be in direct propulsion to the cruising speed, but this relationship is only illustrative.

The DCU Dc starts executing the steering assist mode control (Step S700*b*) to change a fuel injection timing and an ignition timing of the engine E, or these timings and a fuel injection amount, thereby increasing the engine speed. Then, the CPU Dc judges whether or not the operating time $t_o$ has elapsed (Step S800*b*), and when judging that the operating time $t_o$ has elapsed ("YES" in Step S800*b*), the CPU Dc sets back the fuel injection timing and the ignition timing of the engine E or these timings and the fuel injection amount, which were changed to increase the engine speed, to the initial drive state, i.e., the normal drive state (Step S900*b*). On the other hand, when judging that the operating time $t_0$ has not elapsed ("NO" in Step S800*b*), the CPU Dc repeats Steps S100*b*–S800*b* until it judges "NO" in Step S100*b*, S200*b*, or S500*b*.

Figure 15:
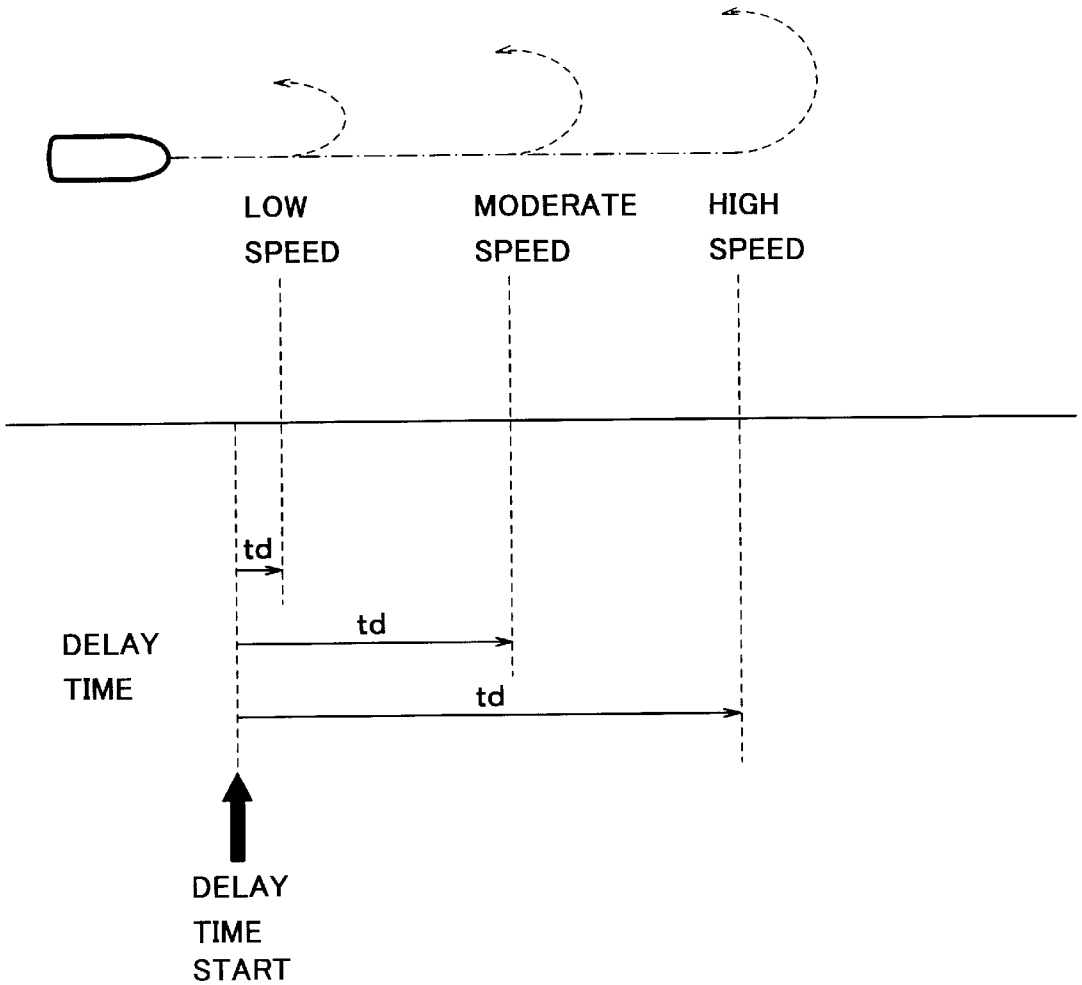
FIG. 15 is a graphic view showing a turning state of the watercraft under the steering assist mode control according to the embodiment of FIG. 11 of the present invention.

In the personal watercraft of this embodiment, according to the above-described procedure, the higher the cruising speed of the watercraft is at the detected point of the throttle-close operation and the steering operation, the longer the delay time $t_d$ is set as shown in FIG. 15. Consequently, a turning response to the steering operation as well as the steering feeling of the rider at the transition to the steering assist mode control is improved. The configuration of this embodiment may be combined into the first embodiment.

The personal watercraft of this embodiment has the above-identified configuration. Since function and effects thereof are similar to those of the first embodiment, the corresponding parts of the second embodiment are referenced to by the same numerals and will not be described in detail.

Figure 16:
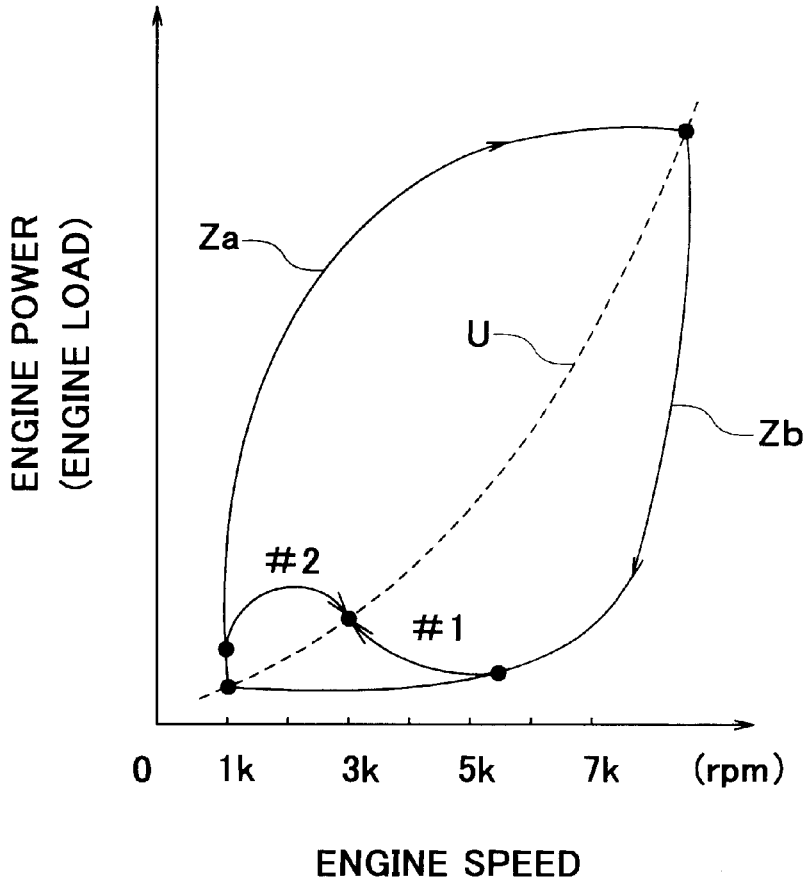
FIG. 16 is a graph showing a hysteresis characteristic between an engine speed and an engine power (engine load), and a propulsive force characteristic of a water jet pump associated with the hysteresis characteristic.

FIG. 16 is a graph showing a hysteresis characteristic between the engine speed and the engine power (engine load), with the engine speed on a lateral axis (lk represents "1000") and the engine power on a longitudinal axis. A dashed line U indicates the propulsive force of the water jet pump P. For example, when the rider preforms throttle-open operation without the steering assist mode control, the engine speed is increased with a degree at which the throttle is opened and the engine power is increased along an ascending line Za. On the other hand, when the rider performs the throttle-close operation in the cruising state, the engine speed is decreased with a degree at which the throttle is closed and the engine power is decreased along a descending line Zb.

Here, it is assumed that the predetermined value at which the steering assist mode control starts is set to 5500 rpm. When the rider performs throttle-close operation when the watercraft is cruising at the engine speed higher than 5500 rpm, the engine speed is decreased in a relatively short time. If the steering assist mode is started when the engine speed is decreased to 5500 rpm, the engine speed is maintained at 3000 rpm (engine speed set under the steering assist mode control) or more upon the steering assist mode control being executed. Accordingly, the propulsive force sufficient to turn the watercraft is obtained (pattern #1). In this case, when the steering assist mode control starts, the watercraft is cruising at the speed higher than 3000 rpm, and therefore, the engine speed is decreased but the engine power is increased up to 3000 rpm on the dashed line U.

In the patter #1, the engine speed is apparently decreased after the steering assist mode control is executed. In actually, however, the engine speed to be decreased in a very short time is maintained at a level (3000 rpm on the dashed line U) at which the propulsive force sufficient to turn the watercraft is obtained. Depending on the controlled speed, there is a possibility that the engine speed becomes temporarily lower that 3000 rpm.

When the steering assist mode control is executed in a state in which the engine speed is lower than 3000 rpm, the engine speed is increased up to 3000 rpm on the dashed line U. Accordingly, the propulsive force sufficient to turn the watercraft is obtained (pattern #2). In this case, when the steering assist mode control starts, the degree at which the engine power is increased is relatively higher than the degree at which the propulsive force is increased, but the engine power is gradually decreased with an increase in the speed of the watercraft.

When the steering assist mode control is started in the state in which the engine speed is 5500 rpm or less on the descending line Zb of this embodiment, the engine speed can be decreased to 3000 rpm on the dashed line U by substantially changing the fuel injection timing, the ignition timing, or these timings and the fuel injection amount and without actually changing the position of the throttle.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meters and bounds of the claims, or equivalence of such meters and bounds thereof are therefore intended to be embodied by the claims.

What is claimed is:

1. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump;

an engine speed sensor for detecting an engine speed of the engine;

a steering operation means that operates in association with a steering nozzle of the water jet pump;

a steering position sensor for detecting a predetermined steering position of the steering operation means;

a throttle-close operation sensor for detecting a throttle-close operation; and an electric control unit adapted to increase the engine speed in response to the steering position sensor detecting the predetermined steering position, the throttle-close operation sensor detecting the throttle-close operation, and the engine speed sensor detecting the engine speed smaller than a first predetermined engine speed.

2. The jet-propulsive watercraft according to claim 1, wherein the electric control unit is adapted to increase the engine speed to increase the propulsive force of the watercraft.

3. The jet-propulsive watercraft according to claim 1, wherein the engine includes a fuel injection system, and the electric control unit is adapted to increase the engine speed by changing the fuel injection timing of the fuel injection system.

4. The jet-propulsive watercraft according to claim 1, wherein the engine includes an ignition system, and the electric control unit is adapted to increase the engine speed by changing the ignition timing of the ignition system.

5. The jet-propulsive watercraft according to claim 1, wherein the engine includes a fuel injection system, and the electric control unit is adapted to increase the engine speed by changing the fuel injection amount of the fuel injection system.

6. The jet-propulsive watercraft according to claim 1, wherein the engine includes a fuel injection system and an ignition system, and the electric control unit is adapted to increase the engine speed by changing the fuel injection timing of the fuel injection system, the ignition timing of the ignition system, and the fuel injection amount of the fuel injection system.

7. The jet-propulsive watercraft according to claim 1, wherein the electric control unit is adapted to increase the engine speed up to approximately 2500 rpm–3500 rpm.

8. The jet-propulsive watercraft according to claim 1, wherein the electric control unit is adapted not to increase the engine speed when the detected engine speed is smaller than a second predetermined engine speed which is smaller than the first predetermined engine speed.

9. The jet-propulsive watercraft according to claim 8, wherein the second predetermined engine speed is an engine speed in an idling range.

10. The jet-propulsive watercraft according to claim 9, wherein the idling range is a range below approximately 2500 rpm.

11. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump, said engine including a fuel injection system;

a steering operation means that operates in association with a steering nozzle of the water jet pump;

a steering position sensor for detecting a predetermined steering position of the steering operation means; and an electric control unit adapted to increase an engine speed of the engine by changing a fuel injection timing of the fuel injection system, in response to the steering position sensor detecting the predetermined steering position.

12. The jet-propulsive watercraft according to claim 11, further comprising:

a throttle-close operation sensor for detecting a throttle-close operation, and wherein the electric control unit is adapted to increase the engine speed in response to the steering position sensor detecting the predetermined steering position and the throttle-close operation sensor detecting the throttle-close operation.

13. The jet-propulsive watercraft according to claim 11, further comprising:

an engine speed sensor for detecting the engine speed, and wherein the electric control unit is adapted to increase the engine speed in response to the steering position sensor detecting the predetermined steering position and the engine speed sensor detecting an engine speed smaller than a first predetermined engine speed.

14. The jet-propulsive watercraft according to claim 11, further comprising:

a throttle position sensor for detecting a throttle-close operation, and wherein the electric control unit is adapted to increase the engine speed in response to the steering position sensor detecting the predetermined steering position and the throttle position sensor detecting the throttle-close operation.

15. The jet-propulsive watercraft according to claim 12, further including a speed sensor for detecting a cruising speed of the watercraft, wherein the electric control unit is adapted to increase the engine speed in response to the steering position sensor detecting the predetermined steering position and the throttle-close operation sensor detecting the throttle-close operation and the speed sensor detecting a predetermined cruising speed of the watercraft.

16. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump, said engine including an ignition system;

a steering operation means that operates in association with a steering nozzle of the water jet pump;

a steering position sensor for detecting a predetermined steering position of the steering operation means; and an electric control unit adapted to increase an engine speed of the engine by changing an ignition timing of the ignition system, in response to the steering position sensor detecting the predetermined steering position.

17. The jet-propulsive watercraft according to claim 16, further comprising:

a throttle-close operation sensor for detecting a throttle-close operation, and wherein the electric control unit is adapted to increase the engine speed in response to the steering position sensor detecting the predetermined steering position and the throttle-close operation sensor detecting the throttle-close operation.

18. The jet-propulsive watercraft according to claim 16, further comprising:

an engine speed sensor for detecting the engine speed, and wherein the electric control unit is adapted to increase the engine speed in response to the steering position sensor detecting the predetermined steering position and the engine speed sensor detecting the engine speed smaller than a first predetermined engine speed.

19. The jet-propulsive watercraft according to claim 16, further comprising:

a throttle position sensor for detecting a throttle-close operation, and wherein the electric control unit is adapted to increase the engine speed in response to the steering position sensor detecting the predetermined steering position and the throttle position sensor detecting the throttle-close operation.

20. The jet-propulsive watercraft according to claim 17, further including a speed sensor for detecting a cruising speed of the watercraft, wherein the electric control unit is adapted to increase the engine speed in response to the steering position sensor detecting the predetermined steering position and the throttle-close operation sensor detecting the throttle-close operation and the speed sensor detecting a predetermined cruising speed of the watercraft.

21. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump, said engine including a fuel injection system;

a steering operation means that operates in association with a steering nozzle of the water jet pump;

a steering position sensor for detecting a predetermined steering position of the steering operation means; and an electric control unit adapted to increase an engine speed of the engine by changing a fuel injection amount of the fuel injection system, in response to the steering position sensor detecting the predetermined steering position.

22. The jet-propulsive watercraft according to claim 21, further comprising:

a throttle-close operation sensor for detecting a throttle-close operation, and wherein the electric control unit is adapted to increase the engine speed in response to the steering position sensor detecting the predetermined steering position and the throttle-close operation sensor detecting the throttle-close operation.

23. The jet-propulsive watercraft according to claim 21, further comprising:

an engine speed sensor for detecting the engine speed, and wherein the electric control unit is adapted to increase the engine speed in response to the steering position sensor detecting the predetermined steering position and the engine speed sensor detecting the engine speed smaller than a first predetermined engine speed.

24. The jet-propulsive watercraft according to claim 21, further comprising:

a throttle position sensor for detecting a throttle-close operation, and wherein the electric control unit is adapted to increase the engine speed in response to the steering position sensor detecting the predetermined steering position and the throttle position sensor detecting the throttle-close operation.

25. The jet-propulsive watercraft according to claim 22, further including a speed sensor for detecting a cruising speed of the watercraft, wherein the electric control unit is adapted to increase the engine speed in response to the steering position sensor detecting the predetermined steering position and the throttle-close operation sensor detecting the throttle-close operation and the speed sensor detecting a predetermined cruising speed of the watercraft.

26. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump, said engine including a fuel injection system and an ignition system;

a steering operation means that operates in association with a steering nozzle of the water jet pump;

a steering position sensor for detecting a predetermined steering position of the steering operation means; and an electric control unit adapted to increase an engine speed of the engine by changing a fuel injection timing of the fuel injection system, an ignition timing of the ignition system, and a fuel injection amount of the fuel injection system, in response to the steering position sensor detecting the predetermined steering position.

27. The jet-propulsive watercraft according to claim 26, further comprising:

a throttle-close operation sensor for detecting a throttle-close operation, and wherein the electric control unit is adapted to increase the engine speed in response to the steering position sensor detecting the predetermined steering position and the throttle-close operation sensor detecting the throttle-close operation.

28. The jet-propulsive watercraft according to claim 26, further comprising:

an engine speed sensor for detecting the engine speed, and wherein the electric control unit is adapted to increase the engine speed in response to the steering position sensor detecting the predetermined steering position and the engine speed sensor detecting the engine speed smaller than a first predetermined engine speed.

29. The jet-propulsive watercraft according to claim 26, further comprising:

a throttle position sensor for detecting a throttle-close operation, and wherein the electric control unit is adapted to increase the engine speed in response to the steering position sensor detecting the predetermined steering position and the throttle position sensor detecting the throttle-close operation.

30. The jet-propulsive according to claim 27, further including a speed sensor for detecting a cruising speed of the watercraft, wherein the electric control unit is adapted to increase the engine speed in response to the steering position sensor detecting the predetermined steering position and the throttle-close operation sensor detecting the throttle-close operation and the speed sensor detecting a predetermined cruising speed of the watercraft.

31. A jet-propulsive watercraft comprising:

a water jet pump that pressurizes and accelerates sucked water and ejects the water from an outlet port provided behind the water jet pump to propel the watercraft as a reaction of the ejecting water;

an engine for driving the water jet pump;

a steering operation means that operates in association with a steering nozzle of the water jet pump;

a steering position sensor for detecting a predetermined steering position of the steering operation means; and an electric control unit adapted to increase an engine speed of the engine in response to the steering position sensor detecting the predetermined steering position, even when the watercraft is moving rearward.

32. The jet-propulsive watercraft according to claim 31, wherein the electric control unit is adapted to increase the engine speed when the detected engine speed is within an idling range.

33. The jet-propulsive watercraft according to claim 32, wherein the idling range is a range below approximately 2500 rpm.

34. The jet-propulsive watercraft according to claim 31, wherein the electric control unit is adapted to increase the engine speed up to approximately 2500 rpm–3500 rpm.

* * * * *

UNITED STATES PATENT AND TRADEMARK OFFICE

CERTIFICATE OF CORRECTION

PATENT NO. : 6,551,152 B2
DATED : April 22, 2003
INVENTOR(S) : Yoshimoto Matsuda et al.

It is certified that error appears in the above-identified patent and that said Letters Patent is hereby corrected as shown below:

Column 14,
Line 63, please change "The jet-propulsive according to" to -- The jet-propulsive watercraft according to --.

Signed and Sealed this

Sixteenth Day of September, 2003

JAMES E. ROGAN
*Director of the United States Patent and Trademark Office*